US008905053B2

(12) United States Patent
Thiyagarajan

(10) Patent No.: US 8,905,053 B2
(45) Date of Patent: Dec. 9, 2014

(54) VARIABLE SPEED AND MULTI-ANGLE NOZZLE SPRAY ARM ASSEMBLY FOR A DISHWASHER

(75) Inventor: Ramasamy Thiyagarajan, Louisville, KY (US)

(73) Assignee: General Electric Company, Schenectady, NY (US)

( * ) Notice: Subject to any disclaimer, the term of this patent is extended or adjusted under 35 U.S.C. 154(b) by 863 days.

(21) Appl. No.: 13/101,273

(22) Filed: May 5, 2011

(65) Prior Publication Data

US 2012/0279530 A1 Nov. 8, 2012

(51) Int. Cl.
*A47L 15/23* (2006.01)
*A47L 15/42* (2006.01)

(52) U.S. Cl.
CPC ..... *A47L 15/23* (2013.01); *A47L 15/4282* (2013.01)
USPC ..... 134/198; 134/179; 134/172; 134/174; 134/176

(58) Field of Classification Search
CPC ..... A47L 15/18; A47L 15/22; A47L 15/23; A47L 15/4221; A47L 15/4248; A47L 15/428; A47L 15/4282; A47L 15/4289; A47L 2501/03; A47L 2501/20; B05B 1/02; B05B 1/14; B05B 1/20; B05B 1/26; B05B 1/34; B05B 1/30; B05B 3/00; B05B 3/008; B05B 3/02
USPC ..... 134/198, 18, 25.2, 56 D, 178, 172
See application file for complete search history.

(56) References Cited

U.S. PATENT DOCUMENTS

| | | | | |
|---|---|---|---|---|
| 2,664,903 | A | 1/1954 | Sway | |
| 5,964,232 | A * | 10/1999 | Chung | 134/176 |
| 2007/0295361 | A1 | 12/2007 | Thiyagarajan et al. | |
| 2008/0105305 | A1 * | 5/2008 | Lum et al. | 137/337 |
| 2010/0108102 | A1 * | 5/2010 | Kehl et al. | 134/25.2 |

FOREIGN PATENT DOCUMENTS

| | | | | |
|---|---|---|---|---|
| EP | 0469184 | A1 * | 2/1992 | A47L 15/23 |
| JP | 4-166124 | | 6/1992 | |

* cited by examiner

*Primary Examiner* — Michael Barr
*Assistant Examiner* — Irina Graf
(74) *Attorney, Agent, or Firm* — Dority & Manning, P.A.

(57) ABSTRACT

A dishwasher includes a rotatable spray arm assembly disposed to discharge water supplied by a pump, with the spray arm assembly having arms that extend radially from a hub. A plurality of spray nozzles are provided along each of the arms to discharge the water at an angular orientation such that a rotational torque is induced to rotate the arms and hub. The spray nozzles are variably positionable on the arms as a function of the degree of centrifugal force on the spray nozzles from the induced rotation of the arms such that angular orientation of the spray nozzles changes as a function of the rotational speed of the arms.

18 Claims, 6 Drawing Sheets

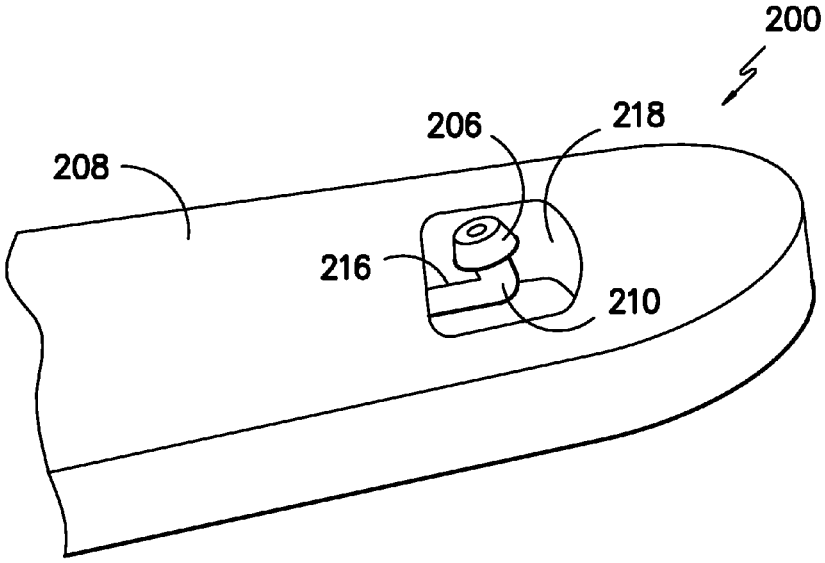
FIG. –6–
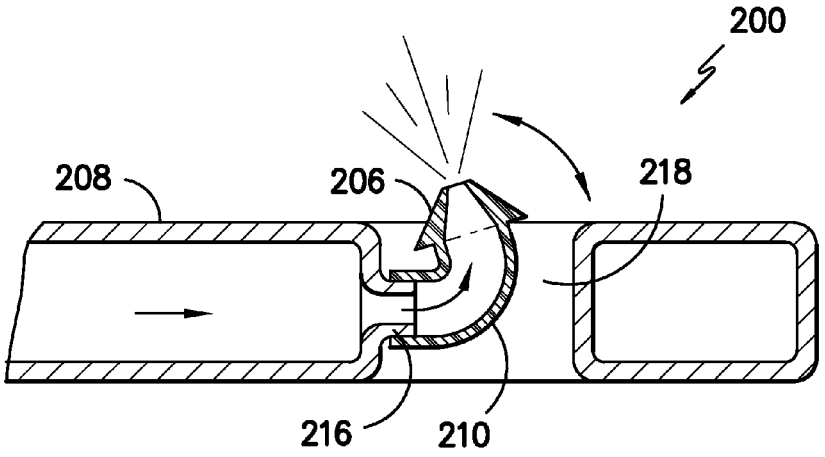
FIG. –7–

VARIABLE SPEED AND MULTI-ANGLE NOZZLE SPRAY ARM ASSEMBLY FOR A DISHWASHER

FIELD OF THE INVENTION

The present subject matter relates generally to dishwashers, and more particularly to a spray arm assembly for fluid distribution within a dishwasher.

BACKGROUND OF THE INVENTION

Conventional dishwashers include a main pump assembly for circulating water through one or more spray arm assemblies, typically an upper and lower spray arm assembly. The spray arm assemblies have arms that extend radially from a central hub, with nozzles or ports provided along the arm for directing the water from the arms at a defined spray pattern. The water pressure and angular orientation of the discharge nozzles generate a rotational torque that causes the arms and hub to rotate.

Typically, the effectiveness of the dishwasher is a function of a number of parameters such as solvent (e.g., water) flow rate, solvent coverage, temperature of the solvent, chemical energy, nozzle geometry, nozzle size, rotational speed (generally expressed in units of revolutions per minute, or "RPM") of spray arm and jet force. The wash cycle of the dishwasher operation requires sufficient solvent flow rate, coverage, thermal and chemical energy. Further, the rinse cycle requires coverage and an amount of solvent that is sufficient for removing detergent and excess food particles from the dishes. Thus, the rinse cycle requires a relatively lower solvent flow rate as compared to the wash cycle for maintaining the same coverage.

In a conventional dishwasher, a single hydraulic system is employed for all modes of operation of the dishwasher cycle such as pre-wash, wash, and rinse cycles. Further, the solvent flow rate and spray coverage/pattern is the same for all these modes of operation. As a result, such dishwashers utilize huge amounts of water and energy for washing the dishes.

Accordingly, a need exists for providing a dishwasher that utilizes substantially lower amounts of water and energy for washing the dishes by tailoring the solvent flow rate (pressure) and spray coverage/pattern to the various operational cycles of the dishwasher.

BRIEF DESCRIPTION OF THE INVENTION

Aspects and advantages of the invention will be set forth in part in the following description, or may be obvious from the description, or may be learned through practice of the invention.

In accordance with aspects of the invention, a dishwasher is provided having a sump configured to store water for washing objects placed within the dishwasher. A rotatable spray arm assembly is disposed to discharge water supplied from a pump within the dishwasher. The spray arm assembly includes arms that extend radially from a hub. A plurality of spray nozzles are provided along each of the arms to discharge the water from the arms at an angular orientation such that a rotational torque is induced to rotate the arms and hub in operation of the spray arm assembly. The spray nozzles are variably positionable on the arms as a function of the degree of centrifugal force experienced by the spray nozzles from the induced rotation of the arms. In this way, the angular orientation of the spray nozzles changes as a function of the rotational speed of said arms.

The spray nozzles may be connected to the arms in various ways. In a particular embodiment, the spray nozzles are connected to a respective arm with a flexible conduit that accommodates the variable angular orientation of the spray nozzle. This conduit may be, for example, a bellows-type member that at least partially collapses along one side as centrifugal force builds on the spray nozzle.

In particular embodiments, the flexible conduit and connected spray nozzle extend above a planar surface of the arm. In other embodiments, the flexible conduit and connected spray nozzle may be disposed within a recess defined in the planar surface of the arm.

The spray nozzles may be variably positionable from an angular static orientation towards a vertical axis of the hub to an angular orientation away from the vertical axis of the hub. In certain embodiments, a connection nub may be configured on the arms at each location of the spray nozzles, with the connection nub having an angular orientation towards the vertical axis of the hub that defines the static orientation of the spray nozzles.

The rotational speed of the rotating spray arm assembly may be controlled by flow rate of water through the spray nozzles. In this regard, in a particular embodiment, the pump may be a variable speed pump such that the rotational speed of the arms and corresponding angular orientation of the spray nozzles is controlled by varying the speed of the pump. In a different embodiment, a variable flow restrictor may be disposed within the conduit between the pump and the hub such that rotational speed of the arms and corresponding angular orientation of the spray nozzles is controlled by varying the position of the flow restrictor.

The present invention also encompasses various embodiments of a spray arm assembly that may have any combination of the features described above or provide in the below examples.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 6 is a perspective view of an alternative embodiment of a spray nozzle configuration;

FIG. 7 is a side cut-away view of the spray nozzle configuration of FIG. 6 in an operational angular orientation of the spray nozzle.

DETAILED DESCRIPTION OF THE INVENTION

Figure 1:
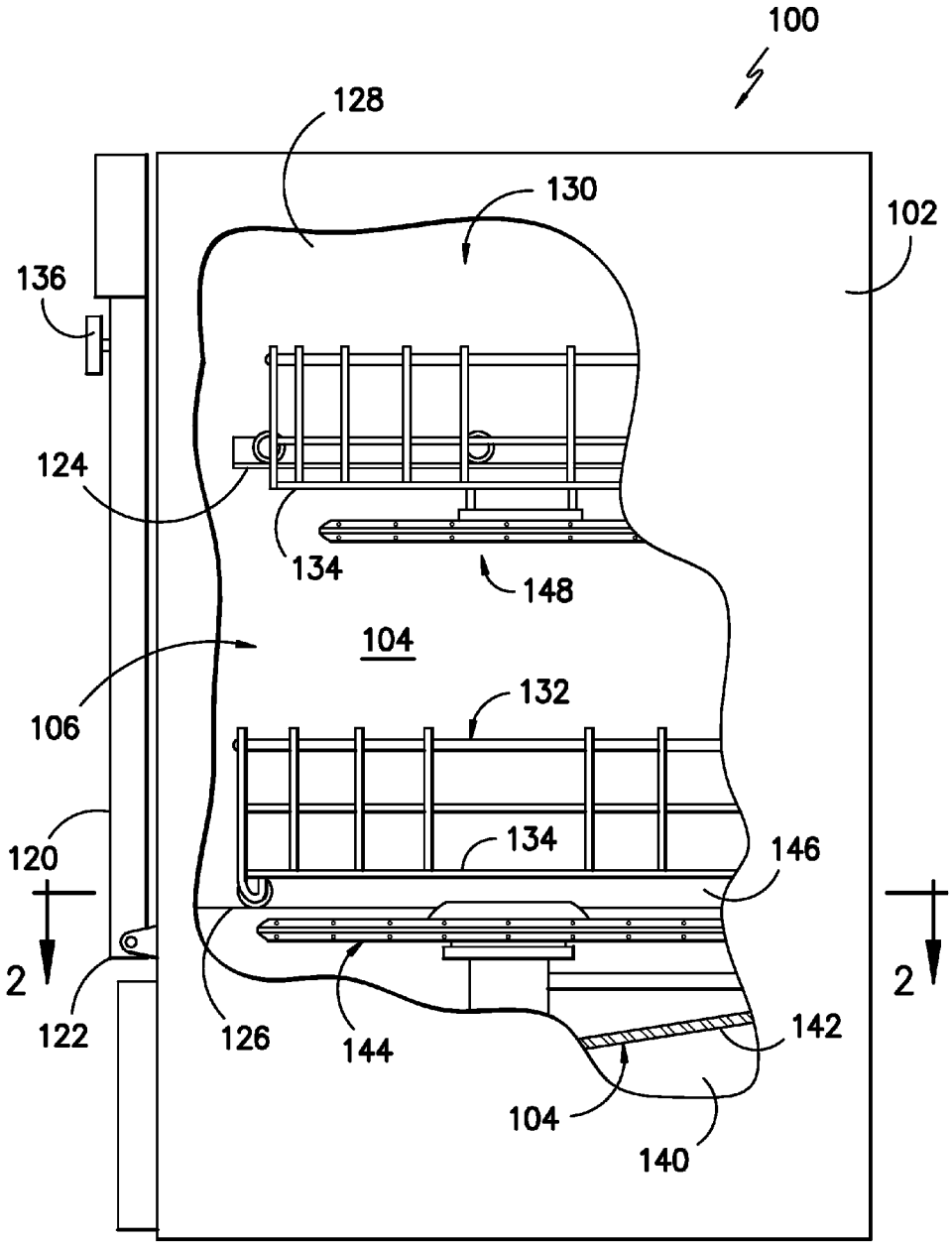
FIG. 1 is a side, partially broken-way view of an exemplary dishwasher.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a view of an exemplary domestic dishwasher system 100 shown in partial cut-away and is representative of a type of a dishwasher that may incorporate aspects of the invention. It is contemplated, however, that the invention may be practiced in other types of dishwashers and dishwasher systems beyond dishwasher system 100 described and illustrated herein. Accordingly, the following description is for illustrative purposes only, and the invention is in no way limited to use in a particular type of dishwasher system, such as dishwasher system 100.

Dishwasher 100 includes a cabinet 102 having a tub 104 therein that defines a wash chamber 106. The tub 104 includes a front opening (not shown in FIG. 1) and a door 120 hinged at its bottom 122 for movement between a normally closed vertical position (shown in FIG. 1) wherein the wash chamber 106 is sealed shut for washing operation, and a horizontal open position (not shown) for loading and unloading of dishwasher contents. Upper and lower guide rails 124, 126 are mounted on tub side walls 128 and accommodate upper and lower roller-equipped racks 130, 132, respectively. Each of upper and lower racks 130, 132 is fabricated from known materials into lattice structures including a plurality of elongate members 134, and each rack 130, 132 is adapted for movement between an extended loading position (not shown) in which the rack is substantially positioned outside the wash chamber 106, and a retracted position (shown in FIG. 1) in which the rack is located inside wash chamber 106. Conventionally, a silverware basket (not shown) is removably attached to the lower rack 132 for placement of silverware, utensils, and the like that are too small to be accommodated by upper and lower racks 130, 132.

A control input selector 136 is mounted at a convenient location on an outer face of the door 120 and is coupled to control circuitry and control mechanisms for operating a fluid circulation assembly to circulate water and dishwasher fluid in the dishwasher tub 104. The fluid circulation assembly is located in a machinery compartment 140 located below a bottom sump portion 142 of the tub 104, and its construction and operation is explained in greater detail below.

A lower spray-arm-assembly 144 is rotatably mounted within a lower region 146 of the wash chamber 106 and above tub sump portion 142 so as to rotate in relatively close proximity to lower rack 132. A mid-level spray-arm assembly 148 is located in an upper region of the wash chamber 106 and is located in close proximity to the upper rack 130 and at a sufficient height above lower rack 132 to accommodate larger items, such as a dish or platter. In a further embodiment, an upper spray arm assembly may be located above the upper rack 130 at a sufficient height to accommodate taller items, such as a glass of a selected height.

Lower and mid-level spray-arm assemblies 144, 148 and the upper spray arm assembly are fed by the fluid circulation assembly, and each spray-arm assembly includes an arrangement of discharge ports or nozzles for directing washing liquid onto dishes located in the upper and lower racks 130, 132, respectively. The arrangement of the discharge ports in the spray-arm assemblies 144, 148 induces a rotational torque by virtue of the angle and force of the water exiting the discharge ports. The resultant rotation of the spray-arm assemblies 144, 148 provides coverage of dishes and other articles with a washing spray. It should be appreciated that one or all of the spray arm assemblies may be rotatably mounted and configured to generate a swirling spray pattern within the wash chamber 106 when the fluid circulation assembly is activated.

Figure 2:
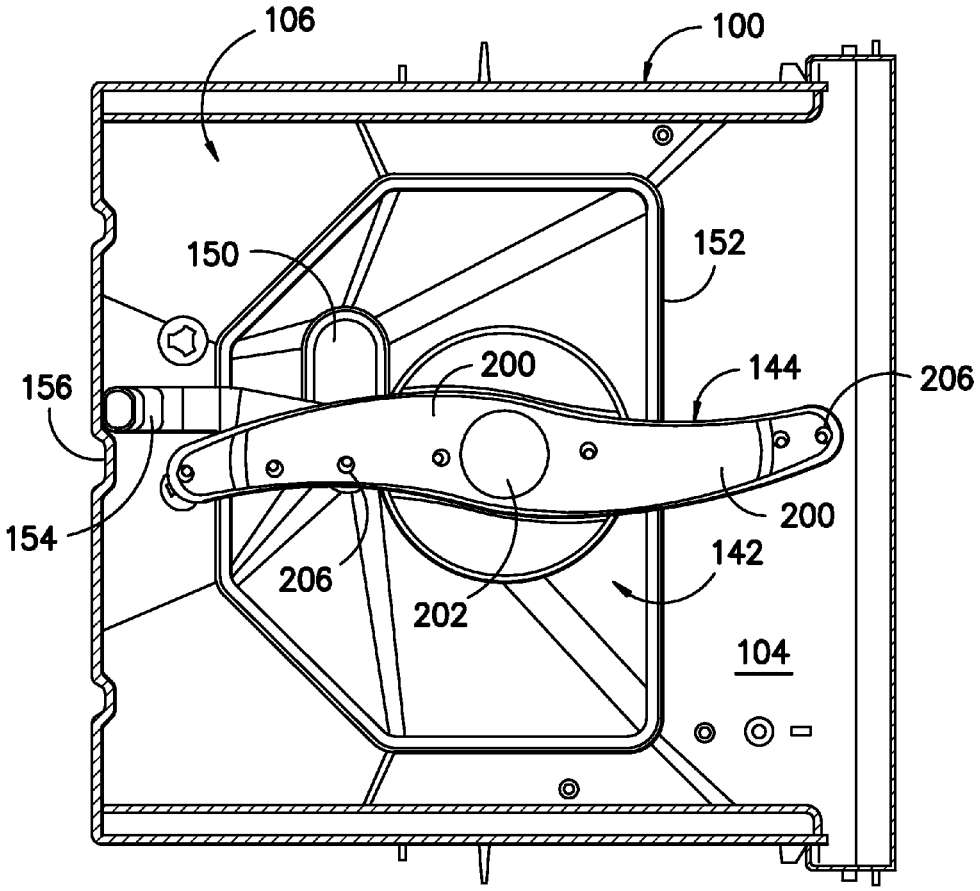
FIG. 2 is a top view of a spray arm assembly from the dishwasher of FIG. 1.

FIG. 2 is a top plan view of a dishwasher 100 just above the lower spray arm assembly 144. The tub 104 is generally downwardly sloped beneath the lower spray arm assembly 144 towards the tub sump portion 142, which is generally downwardly sloped toward a sump 150 in flow communication with the fluid circulation assembly. The tub sump portion 142 includes an outer perimeter 152 and the lower spray arm assembly is substantially centered within the tub 104 and wash chamber 106, off-centered with respect to the tub sump portion 142, and positioned above the tub 104 and the tub sump portion 142 to facilitate free rotation of the spray arm 144.

Water sprayed from the lower spray arm assemblies 144, 148 is collected in the tub sump portion 142 and directed toward sump 150 for filtering and re-circulation via a pump 204 (FIG. 8) during a dishwasher system wash cycle. In addition, a conduit 154 extends beneath lower spray arm assembly 144 and is in flow communication with the fluid circulation assembly 170. The conduit 154 extends to a back wall 156 of wash chamber 106, and upward along back wall 156 for feeding wash fluid to mid-level spray arm assembly 148 and the upper spray arm assembly.

Figure 8:
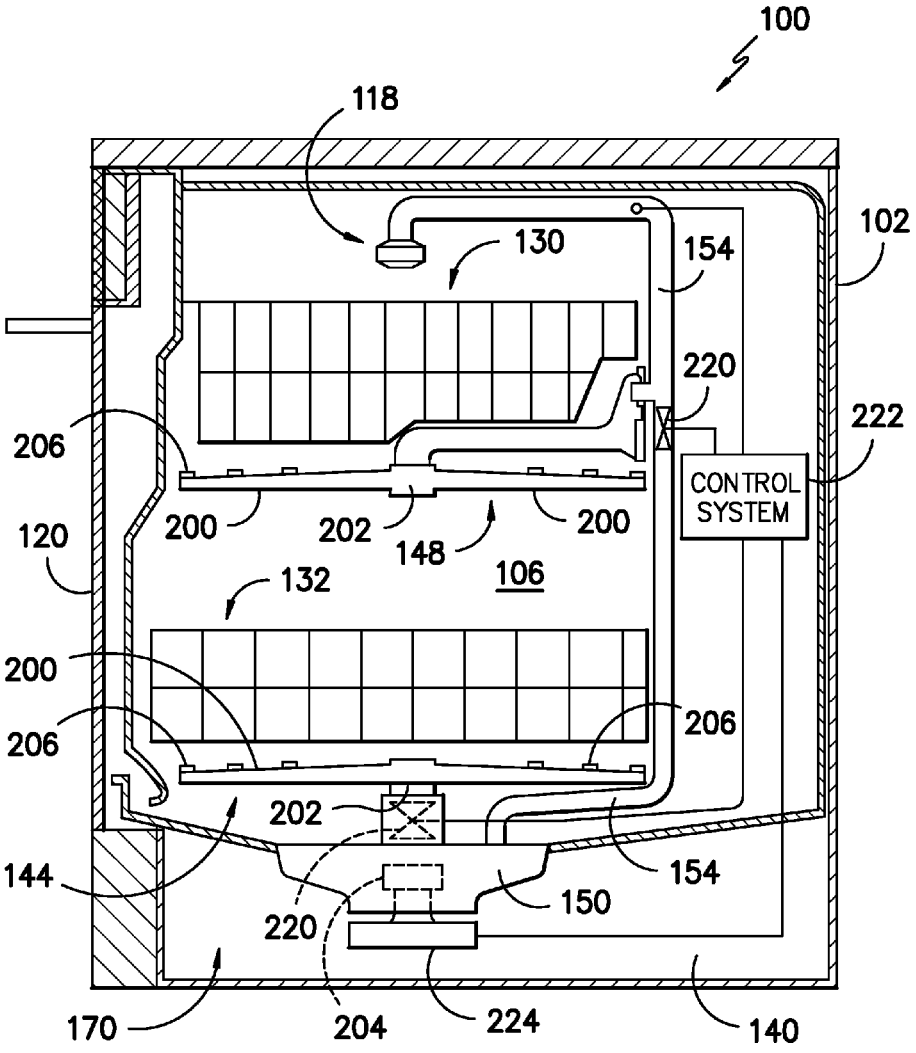
FIG. 8 is a side-cut-away view of an exemplary dishwasher configuration.

Referring to FIG. 8, the fluid circulation assembly 170 is disposed below the wash chamber 106 in the machinery compartment 140 and includes the main pump 204 in fluid communication with the sump 150 to pump washing water stored in the sump. A motor 224 is drivingly coupled to the pump 204, which delivers pressured water to the various spray arm assemblies 144, 148 via the conduit 154.

Referring to FIGS. 2 and 8, the spray arm assembly 144 includes arms 200 that extend radially from a hub 202. A plurality of spray nozzles 206 are provided on the arms 200 to discharge water supplied into the arms from the fluid circulation assembly 170 in a spray pattern within the wash chamber 106. The nozzles 206 are at an angular orientation to generate a rotational torque on the arms 200, which causes the spray arms 200 to rotate when pressurized water is discharged, as in known in the art and described above.

Figures 3A, 3B, 3C:
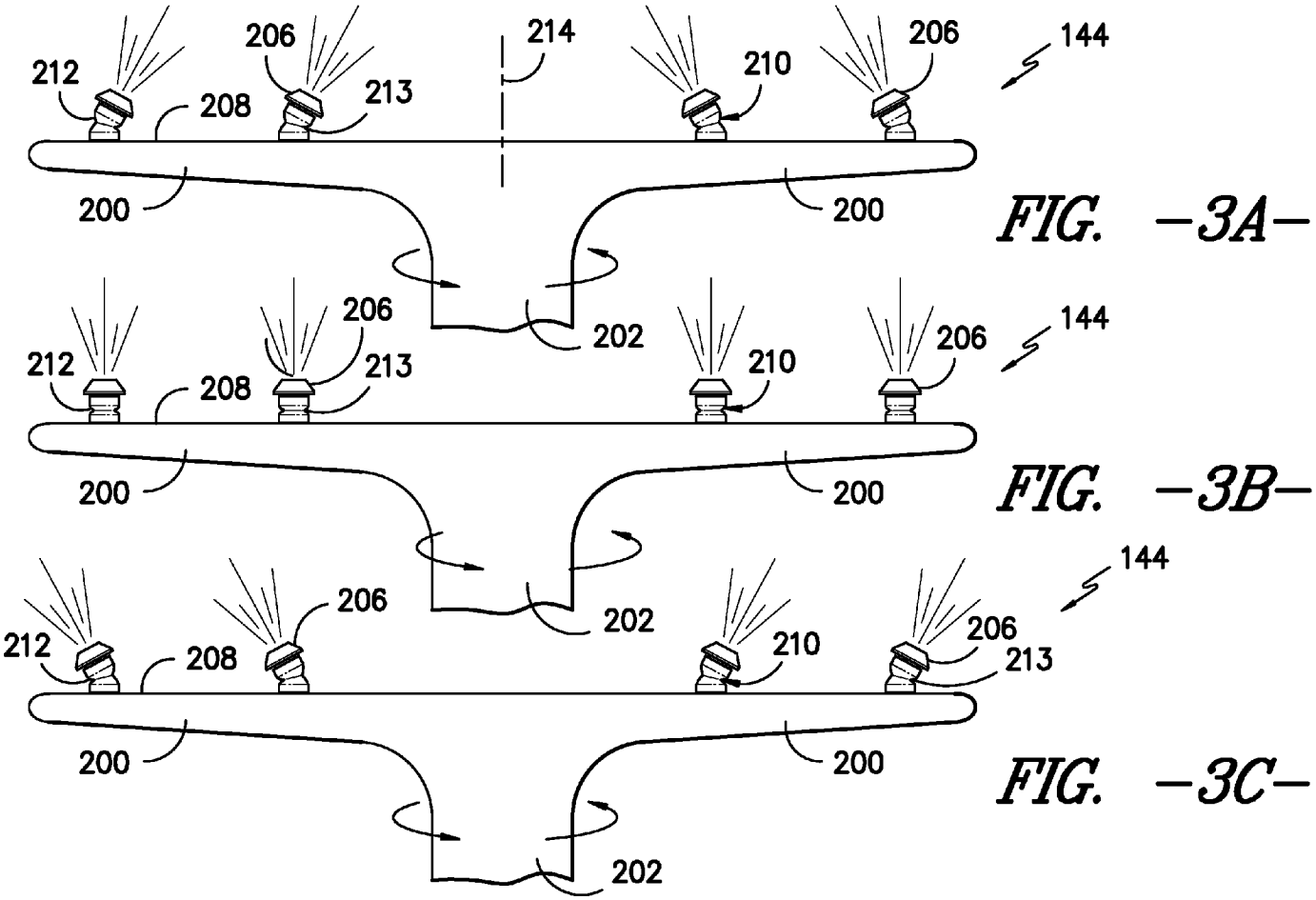
FIGS. 3A through 3C are sequential operational views of a spray arm assembly with variably positionable spray nozzles.

The arms 200 rotate relative to an axis 214 (FIG. 3A) of the hub 202. Referring to FIGS. 3A through 3C, in accordance with aspects of the invention, the nozzles 206 have a variably positionable angular orientation on the arms 200 as a function of the degree of centrifugal force that is experienced by the nozzles 206 from the induced rotation of the arms 200. In other words, the angular orientation of the nozzles 206 changes as a function of the rotational speed of the arms 200. The change in angular orientation of the nozzles 206 is with respect to the axis 214 referenced in FIG. 3A.

For example, referring to FIG. 3A, the nozzles 206 have a first angular orientation relative to the axis 214 at a static or very low rotational speed of the arms 200. As the rotational speed of the arms 200 increases, the centrifugal force acting on the nozzles 206 also increases and the nozzles 206 may assume a different angular orientation with respect to the axis 214, as depicted in FIG. 3B.

As the rotational speed of the arms increases still further, the nozzles 206 may continue to change their angular orientation relative to the axis 214 until the nozzles 206 are actually oriented at an angle that diverges from the axis 214, as depicted in FIG. 3C.

In order to accommodate the changing angular orientation of the nozzles 206, in accordance with one embodiment, a flexible conduit 210 may be used to connect the spray nozzles 206 to their respective arms 200. This flexible conduit 210 allows the nozzles 206 (which may be inserted into one of the ends conduit 210) to react to the change in centrifugal force and assume the various positions indicated, for example, in FIGS. 3A through 3C.

The flexible conduit 210 may assume various shapes and configurations. For example, in the embodiment illustrated in FIGS. 3A through 5, the conduit 210 has a bellows configuration, wherein the conduit 212 readily flexes at the interface 213 of adjacent bellows sections. The flexible conduit 210 may, in other embodiments, be a relatively soft rubber tube that has bending properties to achieve the desired range of angular orientation of the nozzles 206.

The flexible conduit 210 may, in certain embodiments, extend above a planar surface 208 of the spray arm 200, as depicted in the figures. Thus, in this configuration, the degree of angular orientation of the spray nozzles 206 is theoretically limited by the degree of flexibility of the bellows 210 and the point of contact of the nozzles 206 with the upper planar surface 208.

It should be readily appreciated that the present invention encompasses any manner of accommodating the varying angular orientation of the spray nozzles 206 relative to the axis 214 of the arms 200, and that the flexible conduit configuration illustrated in the figures is not a limiting feature of the invention. For example, any manner of suitable gimbal type of joint may be utilized, such as a ball valve configuration between the nozzle 206 and arms 200.

The spray nozzles 206 may have an initial angular orientation in a static state of the arms 200 wherein the axis of the nozzles 206 is angled towards the vertical axis 214 of the hub 202, as illustrated in FIG. 3A. The nozzles may be infinitely variably positionable from this initial orientation to an orientation wherein the axis of the nozzles 206 is angled away from the axis 214, as depicted in FIG. 3C.

Figure 4:
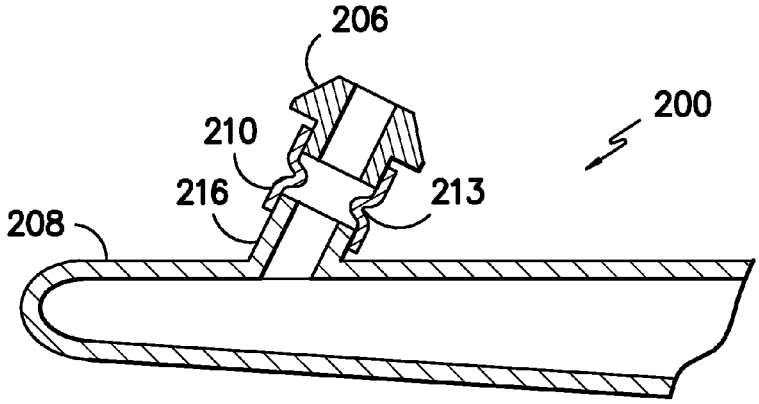
FIG. 4 is a side cut-away view of an exemplary spray nozzle configuration in a static state.
Figure 5:
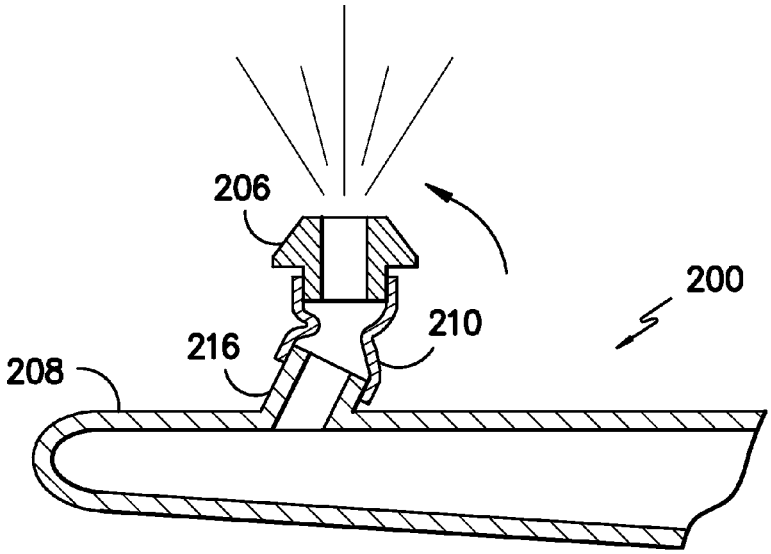
FIG. 5 is a side cut-away view of the spray nozzle of FIG. 4 in an operational angular orientation of the spray nozzle.

FIGS. 4 and 5 depict an embodiment wherein each of the nozzles 206 is connected to the respective arm 200 via a nub 216 formed on the upper planar surface 208 of the arm 200. This nub 216 may have an initial angular orientation relative to the rotational axis of the arm 200 that defines the static position of the nozzle 206, as depicted in FIG. 4. As the centrifugal force experienced by the nozzle 206 increases with increasing rotational speed of the arm 200, the nozzle 206 angles away from the axis 214 (and axis of the nub 216) to the position illustrated in FIG. 5. In certain embodiments, the angle of the nozzle 206 may increase even further than that depicted in FIG. 5 such that the nozzle 206 is angled away from the axis 214, as depicted in FIG. 3C.

FIGS. 6 and 7 illustrate an alternative embodiment wherein the spray nozzles 206 are housed within respective recesses 218 formed in the upper planar surface 208 of the arms 200. Again, a flexible conduit 210 may be used to connect the nozzle 206 to a nub 216, as depicted in FIG. 7. The nub 216 may have an initial angular orientation to define a static position for the nozzle 206 with a relatively straight conduit 210. In the illustrated embodiment, the conduit 210 has an angled elbow configuration that defines an initial static position of the nozzle 206 depicted in FIG. 7. The recess 218 has a depth and radial width dimension so as to accommodate a full range of movement of the nozzle 206.

It should be appreciated that the flexible conduit 210 need not be a separate component from the spray nozzle 206. In other words, the nozzle 206 may be formed directly as an integral component of the conduit 210.

The nozzles 206 may be variously configured within the scope and spirit of the invention, and may have any cross-sectional shape, spray pattern, and the like.

It should be appreciated that the centrifugal force acting on the variably positionable nozzles 206 is a function of the rotational speed of the arms 200, which is in turn a function of the pressure and flow rate of the water through the nozzles 206. Thus, the angular orientation of the nozzles 206 with respect to the vertical axis 214 of the spray arm hub 202 can be controlled by varying the flow rate and pressure of the water provided to the arms 200. Referring to FIG. 8, one configuration for achieving this control function is to provide a variable speed pump 204 (in particular a variable speed motor 224) such that the rotational speed of the arms 200 is controlled by varying the speed of the pump via a controller 222, for example as a function of various wash cycles.

In the embodiments wherein it is not desired to utilize a variable speed pump/motor 204/224, an alternative configuration for controlling the flow rate and pressure of water to the arms 200 is to provide a controllable flow restrictor 220 in the fluid supply line to the hub 202. This controllable flow restrictor 220 may be, for example, a variably positionable solenoid valve, or any other manner of electro-mechanical restrictor that will function to variably control the flow rate of water to the respective spray arm assembly hubs 202.

The present invention also encompasses any manner of spray arm assembly 144, 148 that may incorporated into any manner of conventional dishwasher, wherein the spray arm assembly is in accordance with aspects of the invention described herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher, comprising:

a rotatable spray arm assembly disposed to discharge water from a pump within said dishwasher, said spray arm assembly comprising arms that extend radially from a hub;

a pump configured to deliver water to said spray arm assembly;

a plurality of spray nozzles provided along each of said arms to discharge the water from said arms at an angular orientation such that a rotational torque is induced to rotate said arms and said hub, each of said plurality of spray nozzles is attached to one of said arms through a separate respective conduit; and wherein each spray nozzle is variably positionable on one of said arms through the separate respective conduit as a function of the degree of centrifugal force on said spray nozzles from the induced rotation of said arms such that angular orientation of said spray nozzles changes as a function of the rotational speed of said arms; and wherein each of the separate respective conduits is a flexible conduit that accommodates the variable angular orientation of said spray nozzle.

2. The dishwasher as in claim 1, wherein each of said spray nozzles is fluidly connected to said arms through said separate respective conduits.

3. The dishwasher as in claim 1, wherein said flexible conduits each comprise a bellows or tubular configuration.

4. The dishwasher as in claim 1, wherein said flexible conduits and respective spray nozzles extend above a planar surface of said arm.

5. The dishwasher as in claim 1, wherein said spray nozzles are variably positionable from an angular orientation towards a vertical axis of said hub to an angular orientation away from the vertical axis of said hub.

6. The dishwasher as in claim 5, further comprising a connection nub configured on said arm at each location of said spray nozzles, said connection nub having an angular orientation towards said vertical axis of said huh that defines a static orientation of said spray nozzles.

7. The dishwasher as in claim 6, wherein each of said spray nozzles is connected to a respective connection nub by said separate respective conduit.

8. The dishwasher as in claim 1, wherein said spray nozzles are disposed in recesses defined in a planar surface of said arms.

9. The dishwasher as in claim 8, wherein each spray nozzle is connected to a respective connection nub within a respective recess with said separate respective conduit, said separate respective conduit being said flexible conduit and having a shape and orientation so as to define a static angular orientation of said spray nozzles towards a vertical axis of said hub.

10. The dishwasher as in claim 1, wherein said pump is a variable speed pump such that rotational speed of said arms and corresponding angular orientation of said spray nozzles is controlled by varying the speed of said pump.

11. The dishwasher as in claim 1, further comprising a variable flow restrictor disposed within a conduit between said pump and said hub such that rotational speed of said arms and corresponding angular orientation of said spray nozzles is controlled by varying the position of said flow restrictor.

12. A spray arm assembly for a dishwasher, comprising:

a hub;

at least two arms that extend radially from said hub, wherein water is supplied to said hub and directed into said arms in operation of said spray arm assembly;

a plurality of spray nozzles provided along each of said arms to discharge the water from said arms at an angular orientation such that a rotational torque is induced to rotate said arms and said hub in operation of said spray arm assembly, each of said plurality of spray nozzles attached to one of said arms through a separate respective conduit; and wherein each spray nozzle is variably positionable on one of said arms through the separate respective conduit as a function of the degree of centrifugal force on said spray nozzles from the induced rotation of said arms such that said angular orientation of said spray nozzles changes as a function of the rotational speed of said arms; and wherein each of the separate respective conduits is a flexible conduit that accommodates the variable angular orientation of said spray nozzle.

13. The spray arm assembly as in claim 12, wherein said conduits each comprise a bellows or tubular configuration.

14. The spray arm assembly as in claim 12, wherein said conduits and respective spray nozzles extend above a planar surface of said arm.

15. The spray arm assembly as in claim 12, wherein said spray nozzles are variably positionable from an angular orientation towards a vertical axis of said hub to an angular orientation away from the vertical axis of said hub.

16. The spray arm assembly as in claim 15, further comprising a connection nub configured on said arm at each location of said spray nozzles, said connection nub having an angular orientation towards said vertical axis of said hub that defines a static orientation of said spray nozzles, and further comprising said flexible conduit connecting said spray nozzles to said nubs.

17. The spray arm assembly as in claim 12, wherein said spray nozzles are disposed in recesses defined in a planar surface of said arms.

18. The spray arm assembly as in claim 17, wherein each spray nozzle is connected to a respective connection nub within a respective recess with said separate respective conduit, said separate respective conduit being said flexible conduit and having a shape and orientation so as to define a static angular orientation of said spray nozzles towards a vertical axis of said hub.

* * * * *